US005530300A

United States Patent [19]

Powers et al.

[11] Patent Number: 5,530,300

[45] Date of Patent: Jun. 25, 1996

[54] EXTENDED RANGE WIRED REMOTE CONTROL CIRCUIT

[75] Inventors: Russell L. Powers, Willowbrook; Doug R. Turner; James S. Chang, both of Arlington Heights, all of Ill.

[73] Assignee: The Chamberlain Group, Inc., Elmhurst, Ill.

[21] Appl. No.: 400,182

[22] Filed: Mar. 6, 1995

Related U.S. Application Data

[63] Continuation of Ser. No. 10,687, Jan. 28, 1993, abandoned.

[51] Int. Cl.[6] ..... E05B 47/00

[52] U.S. Cl. ..... 307/125; 340/825.69; 307/117; 307/141

[58] Field of Search ..... 341/176; 340/825.32, 340/825.72; 455/114, 63, 119–121; 307/117, 125, 140–141

[56] References Cited

U.S. PATENT DOCUMENTS

| | | | |
|---|---|---|---|
| 4,771,218 | 9/1988 | McGee | 318/16 |
| 4,878,052 | 10/1989 | Schulze | 340/825.69 |
| 5,029,662 | 7/1991 | Pena | 180/167 |
| 5,281,970 | 1/1994 | Blaese | 341/176 |

OTHER PUBLICATIONS

Catalog page and dealer price list: "New Productsion Offered.Pneumatic Edge Controls"; pricing eff. Feb. 1, 1992; MMTC, Inc., Chester, New Jersey 07930.

*Primary Examiner*—Peter S. Wong
*Assistant Examiner*—Aditya Krishnan
*Attorney, Agent, or Firm*—Fitch, Even, Tabin & Flannery

[57] ABSTRACT

A range extender module for extending the range capability of a barrier control system comprising a low voltage AC control unit which receives low voltage AC control signals conveyed by wires to input terminals thereof from a plurality of remotely located switches and responds to such AC control signals by controlling the barrier. The controlled barrier may be, for example, a garage door or a driveway gate. The range extender module is inserted into the wires between the low voltage AC control unit and the remote switches and includes a source of DC voltage, which is used to energize the formerly AC energized switches and responds to DC input signals created by operator interaction with the switches by selectively gating low voltage AC control signals to appropriate input terminals of the low voltage AC control unit for controlling the barrier. The use of DC voltage to energize the remote switches avoids problems caused by the use of low voltage AC signals over wires which exhibit a significant reactive component of impedance.

11 Claims, 2 Drawing Sheets

EXTENDED RANGE WIRED REMOTE CONTROL CIRCUIT

This application is a continuation of application Ser. No. 08/010,687, filed Jan. 28, 1993 now abandoned.

BACKGROUND OF THE INVENTION

This invention relates to remotely controlling AC operated barrier moving systems in response to low voltage AC control signals conveyed by wire from a remote location and, more particularly, to methods and apparatus for improving the control signal range capability between the remote location and the barrier moving system.

Existing barrier control systems, such as garage door or driveway gate systems, typically include a control unit which responds to low voltage AC input signals to open, close, or stop the movement of a driveway gate or garage door. In a normal installation, the control unit at the location of the barrier is connected to one or more switches remotely located in, for example, a residence some distance from a gate to be moved. Low voltage AC, e.g., 24 volts, is applied over wires from the control unit to the remote switches and selectively returned over wires to the control unit by manual operation of the switches. Frequently the wire installed with the system is of small gauge, e.g., 22 gauge, which is run to and from the remote location in a closely spaced bundle and perhaps in a grounded conduit.

Such small gauge wire installation serves to keep the system cost low and provides adequate service for limited distances between the control unit and the remotely located switches. The AC operated control unit, however, requires a minimum of low voltage AC power at its signaling inputs in order to properly respond to control signals. The small gauge, closely spaced wires used in a normal system exhibit a significant reactive component of impedance which reduces the power available at the input of the control unit for control signals. When the distance between the remote switches and the control unit is too long, the available power may not be sufficient for reliable control. It has been found that low voltage AC controlled systems wired as above-described operate satisfactorily over distances of only approximately 80 to 100 feet. Also, over the lifetime of such a barrier control system, aging and possible deterioration of the equipment may reduce the operating distance and make a formerly operating system non-operational. Installing wiring having a reduced reactive component of impedance in new systems and similarly refitting previously installed systems may improve the range of reliable operation but such greatly increases system cost and inconvenience of installation.

A need exists for arrangements which can increase the distance capability between a low voltage AC barrier control unit and remote switches simply and cost-effectively.

SUMMARY OF THE INVENTION

This need is met and a technical advance is achieved in accordance with the present invention, which provides a cost-effective way of extending remote control distance capability in a manner which provides for easy and rapid installation. In accordance with a preferred embodiment, a single module is provided which is connected by existing wiring between a low voltage AC control unit and associated remote switches. The module includes means for converting available low voltage AC to low voltage DC which powers the remote switches. The selective closing of the remote switches returns DC signals to the extender module, which responds thereto by sending corresponding low voltage AC signals to the low voltage AC barrier control unit. The movement and position of the barrier are then controlled in response to the low voltage AC signals. By providing low voltage DC to the remote switches, the reactive impedance component of existing wiring is not a factor and the range capability of the system is increased. Further, the use of a single module with a limited number of required connections to provide all necessary functions for range extension makes installation, whether new or refit, a simple and inexpensive task.

In the case of existing systems, the range extender module may be located near the low voltage AC barrier control unit to convert the existing wiring to the remote switches to conveying DC signals. Such an installation is desirable when the system no longer has the range capability it had when originally installed. When it is desired to extend the distance between the remote switches and the control unit, the range extender module may be connected at the location previously occupied by the remote switches and the distance between the range extender module and newly placed remote switches can be added to the total distance between those remote switches and the AC control unit.

In the embodiment, the range extender module includes a plurality of DC responsive relays, each of which is energized and de-energized by manually controlling a corresponding one of the remote switches. When a given DC relay is energized, its then closed contacts gate low voltage AC to appropriate terminals of the low voltage AC control unit. The low voltage AC control unit responds to the low voltage AC signals forwarded by the range extender module in the same manner as if they came directly from the remote switches.

The range extender module uses a supply of low voltage AC signals to selectively forward to the low voltage AC control unit. When such low voltage AC is available from the low voltage AC control unit, the low voltage is provided at the range extender module by wire connections to the low voltage AC control unit. Alternatively, when the range extender module is located remotely from the low voltage AC control unit and wired connection to its low voltage AC power is not practical, the range extender module contains a separate converter, such as a voltage reduction transformer, to convert commercial voltages, e.g., 110 volts AC or 220 volts AC, to the low voltage AC needed.

DETAILED DESCRIPTION OF THE PREFERRED EMBODIMENT

Figure 1:
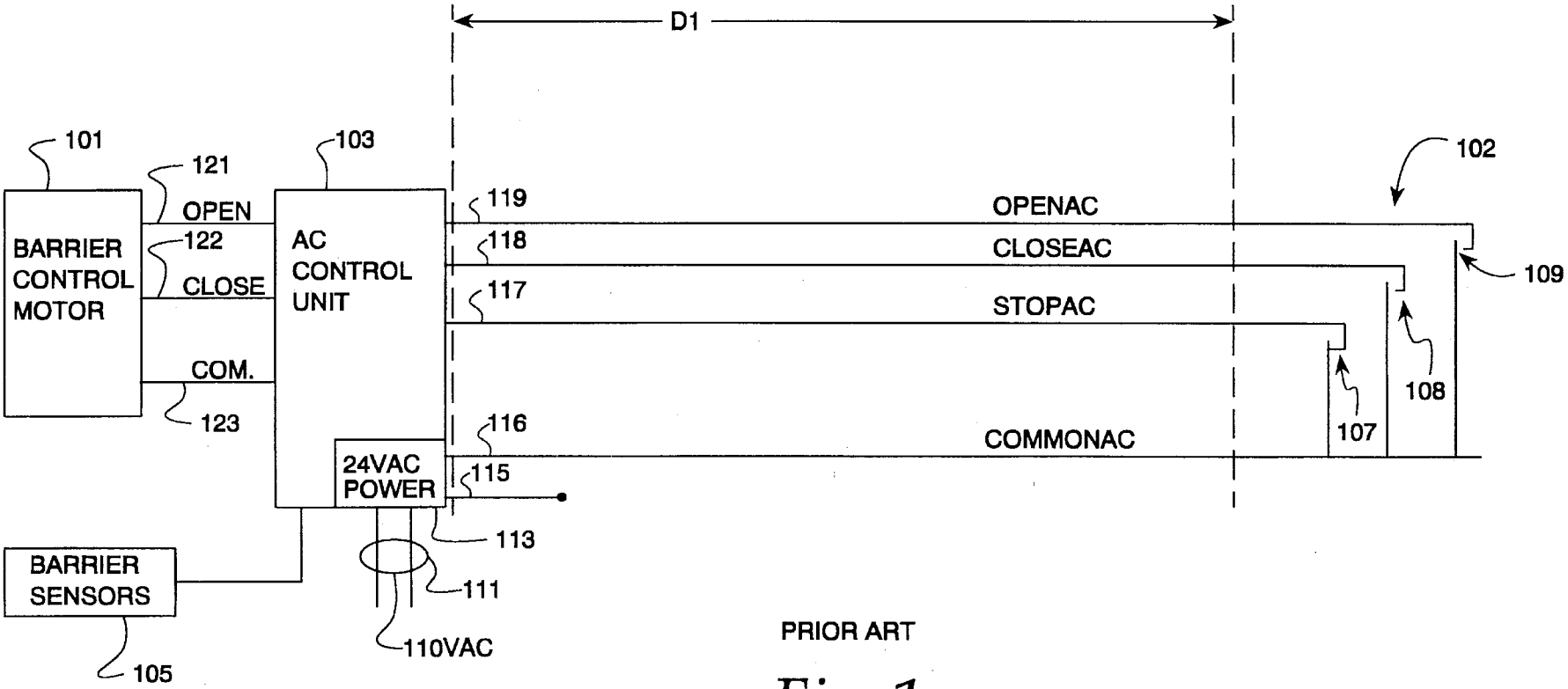
PRIOR ART Fig. 1
FIG. 1 is a block diagram of prior low voltage AC controlled barrier moving system.

FIG. 1 represents a known low voltage AC controlled barrier control system comprising a barrier control motor 101, a low voltage AC control unit 103 with a plurality of barrier sensors 105 and three control switches 107, 108 and 109 at a remote location 102. AC control unit 103 includes the intelligence of the system and responds to low voltage AC input signals from the switches 107–109 by opening, closing and stopping the barrier. Although not shown in detail in FIG. 1, barrier sensors 105 include open and closed limit switches, and obstruction sensors which are powered by the low voltage AC of the AC control unit 103. AC control unit 103 responds to signals from the barrier sensors 105 to properly and safely control barrier movement.

AC control unit 103 receives a line voltage such as 110 volts AC at terminals 111 and converts a portion thereof to 24 volts AC in a power converter 113. The 24 volt AC is produced between terminals 115 and 116 and is used to power the barrier sensors 105, the remote switches 107–109 and the control unit 103. In FIG. 1, low voltage AC terminal 115 is not shown to be connected. However, it is connected internal to AC control unit 103 to implement the barrier control function. Although not specifically needed in the system of FIG. 1, the conductor 115 may also be run to the remote location 102 of switches 107–109. As shown in FIG. 1, voltage from AC conductor 116 is connected to one terminal of each of the three manually operated remote switches 107–109. Switch 107 is a normally closed switch which disconnects 24 volts AC from a STOPAC conductor 117 when the switch 107 is pressed. Remote switches 108 and 109 are normally open switches which connect 24 volts AC to a respective one of conductors 118 and 119 when they are pressed.

AC control unit 103 responds to input AC signals on conductor 119 by opening the barrier responsive to signals from barrier sensors 105. Similarly, AC control unit 103 responds to input AC signals on conductor 118 by closing the barrier responsive to signals from barrier sensors 105. If the barrier is moving when low voltage AC is removed from conductor 117, the motion of the barrier is stopped by the AC control unit 103. Control of the barrier is exercised by selectively applying 110 volts AC to motor 101 via an open conductor 121, a close conductor 122, and a common conductor 123.

One known system of the type described above is the Model 2000HT, manufactured by The Chamberlain Group, Inc. Such a low voltage AC controlled system performs admirably. However, due to the reactive impedance in conductors 115–119, the low voltage AC input signals may be too attenuated by the time they are returned to AC control unit 103, to be properly responded to. This limits the distance (D1, FIG. 1) between remote switches 107–109 and the AC control unit 103 to approximately 80 to 100 feet.

Figure 2:
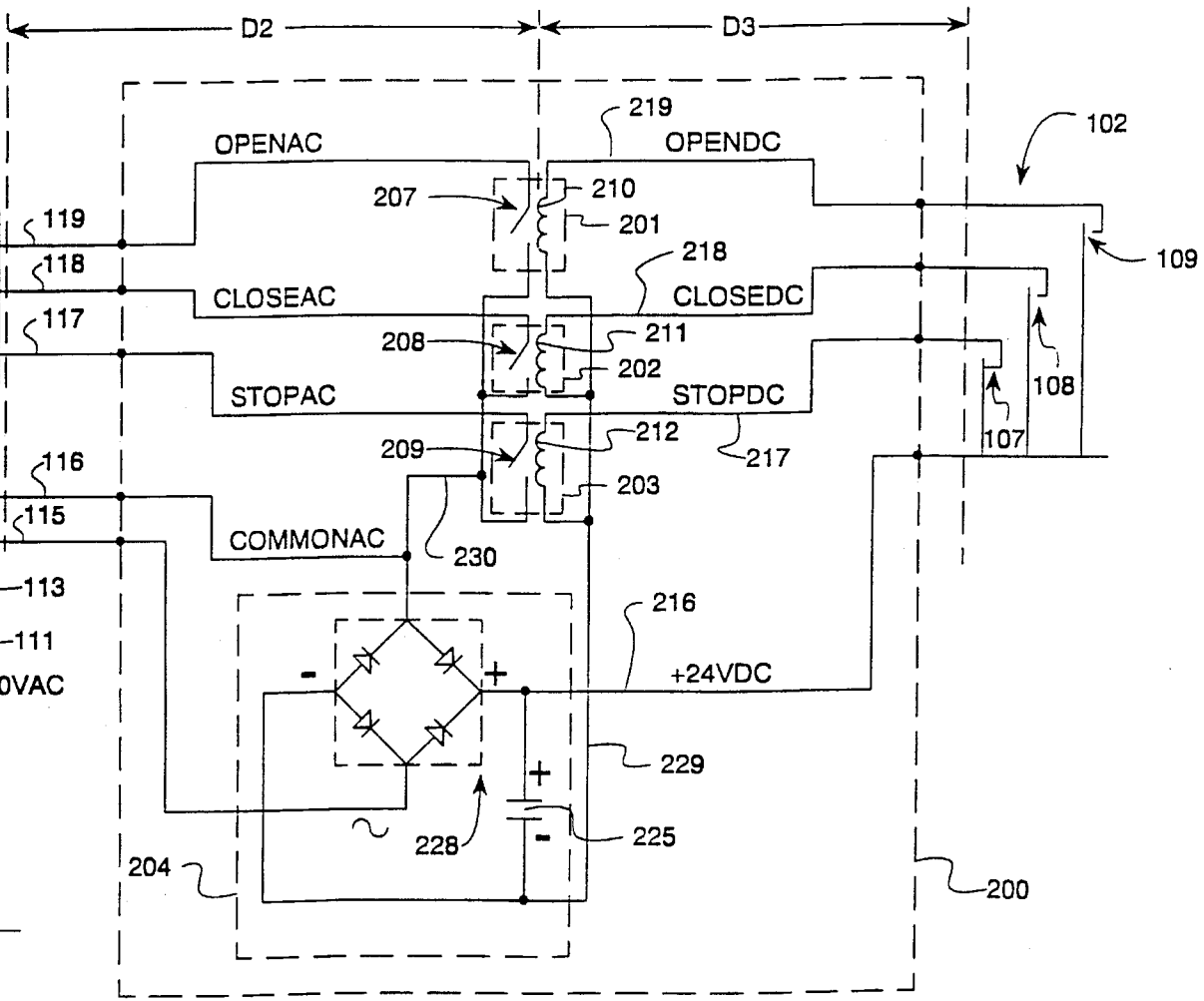
FIG. 2 is a block diagram of a low voltage AC controlled barrier movement system including a range extender module.

FIG. 2 shows a barrier control system which includes a range extender module 200, to extend the distance capability between the switches 107–109 and AC control unit 103, in accordance with the present invention. In FIG. 2, components having the same numerical designation as components in FIG. 1 are substantially identical to their counterparts in FIG. 1. Range extender module 200 includes a 24 volt DC power supply 204 and three relays 201, 202 and 203. Relay 201 comprises a normally open contact set 207 and a DC sensitive coil 210, relay 202 comprises a normally open contact set 208 and a DC sensitive coil 211, and relay 203 comprises a normally open contact set 209 and a DC sensitive coil 212. 24 volts AC power supply 204 comprises a diode bridge 228 connected to receive 24 volts AC power over conductors 115 and 116 and to apply its positive and negative outputs to conductors 216 and 215, respectively, via a capacitive filter 225. The positive output of power supply 204 is connected by wire 216 in common to one terminal of each of the switches 107, 108 and 109. The negative output terminal of power supply 204 is connected via a conductor 229 to one terminal of each of the three DC relay coils 210, 211 and 212.

In FIG. 2, remote switch 107 is normally closed while remote switches 108 and 109 are normally open. Whenever switch 109 is pressed, a DC voltage is applied across coil 210, causing normally open contact 207 to close. Contact set 207 is connected by conductor 230 in series between 24 volt AC conductor 116 and OPENAC conductor 119. Closing contact set 207 applies 24 volt OPENAC signal to AC control unit 103 via the conductor 119, to which AC control unit 103 will appropriately respond. Relay 202 is connected in a substantially similar fashion to relay 201 so that when switch 108 is depressed, a 24 volt AC signal is applied via contact set 208 to the AC control unit 103 via CLOSEAC conductor 118. It will be remembered that switch contact 107 is normally closed. Accordingly, relay coil 212 will normally be energized, causing a continuous 24 volts AC signal to be applied via contact set 209 and conductor STOPAC 117 to the AC control unit 103. When switch 107 is pressed, the resulting open circuit causes contact set 209 to open, which removes the STOPAC signal from conductor 117.

The range extender module 200 may conveniently be placed in close proximity to the AC control unit 103. Since DC voltage is transmitted to the remote switches 107–109, the previously encountered problem of reactive impedance is avoided and the range between the range extender module 200 and the switches 107–109 can be larger than when AC signaling is employed without impaired service. Thus, in terms of FIG. 2, the dimension D2 may advantageously be chosen to be short and the range extender module 200 will provide an extended range D3 between the range extender module and the switches 107–109.

The range extender module 200 can also be placed remote from AC control unit 103, provided the length of the conductors 115–119 (D2, FIG. 2) is within the range capability of the AC control unit 103. For example, if an existing system places switches 107–109 approximately 75 feet (within the AC signaling range) of AC control unit 103 and it is desired to extend the distance between the AC control unit and the switches 107–109 by an additional 100 feet, the range extender module could be provided at the 75 foot location of the switches (D2=75 feet). The additional range capability created by range extender module 200 could then be used to remote switches 107–109 by an additional 100 feet (D3=100 feet) or more.

Figure 3:
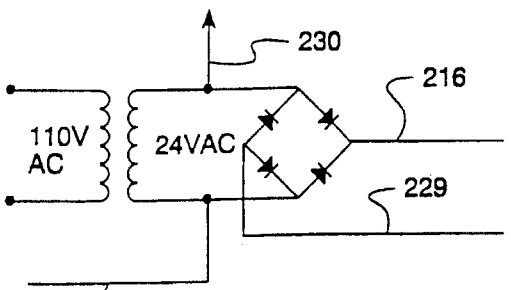
FIG. 3 is a representation of a low voltage AC generating circuit for use with remoted range extender modules.

In certain situations, particularly when the range extender module is to be connected remotely from AC control unit 103, the low voltage AC on conductors 115 and 116 may not be available, or may be sufficiently weak that it cannot be used remotely. In such situations, other sources of DC voltage for the control of relays 201, 202 and 203 by means of switches 107, 108 and 109 can be employed. In the example shown in FIG. 3, when 24 volts AC is not available at the location of the range extender module 200, power supply 204 could include a transformer to convert ordinary 110 volts AC commercial power to 24 volts AC. When low voltage AC is produced by the range extender module, it may also be necessary to connect one low voltage AC terminal to the relay contacts via conductor 230 and to return the low voltage AC common to the low voltage AC control unit via a conductor such as 115 or 116.

What is claimed is:

1. Apparatus for controlling low voltage AC equipment at a first location from a remote second location over control conductors which exhibit a reactive component of impedance which is too large to convey low voltage AC power to activate said low voltage AC equipment, comprising:

a low voltage AC source having a first terminal and a second terminal producing low voltage AC power;

means at said first location for converting a portion of said low voltage AC power to DC voltage;

switching means at said first location responsive to direct current for closing a normally open contact set, said switching means having a pair input terminals for receiving said direct current;

means for connecting said low voltage AC equipment in series with said normally open contact set to said low voltage AC source;

a remote switch at said second location; and means for connecting said remote switch in series with said means for converting low voltage AC power to DC voltage, the input terminals of said switching means and the control conductors.

2. In apparatus for controlling the position of a barrier at a first location in response to low voltage AC from a low voltage AC source controlled by a DC voltage over a pair of control conductors by at least one manually controlled switch at a second location remote from the first location, a modular control unit for extending the distance between said first location and said second location at which effective wired control can occur, comprising:

means for converting a portion of the low voltage AC power output of said low voltage AC source to said DC voltage;

at least one DC responsive relay having a relay control coil having a first coil terminal and a second coil terminal for receiving said DC voltage and having a contact set controlled by said relay control coil in response to application of said DC voltage to control the flow of AC power;

means for connecting a first polarity of said DC voltage to said first coil terminal and for connecting a second polarity of said DC voltage to said second coil terminal in series with said pair of said control conductors and said manually controlled switch; and means for connecting low voltage AC from said low voltage AC source to a low voltage AC control unit at said first location for the control of the position of said barrier including said normally open contact set of said DC responsive relay.

3. A range extender module for extending an effective wired control range of a barrier control system having a low voltage AC control unit which receives low voltage AC control signals conveyed by wires to input terminals thereof from a plurality of remotely located switches and responds to such AC control signals by controlling the barrier, comprising:

a source of low voltage AC;

a source of DC voltage;

means for connecting the source of DC voltage to the plurality of switches to produce DC input signals;

means for receiving DC input signals selectively transmitted by operator interaction with the plurality of switches; and means responsive to the DC input signals for selectively connecting low voltage AC signals from the low voltage source to the input terminals of the low voltage AC control unit.

4. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 3 for extending the range capability of a barrier control system further comprising a low voltage AC producing means and wherein said source of low voltage AC comprises a wired connection to said low voltage AC producing means.

5. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 4 wherein said source of DC voltage comprises means for rectifying and filtering low voltage AC from the low voltage AC producing means.

6. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 3 wherein said source of DC voltage comprises means for converting commercial AC into a low voltage DC.

7. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 3 wherein said means for connecting the source of DC voltage comprises DC output terminal means connected to said plurality of switches via the wires previously connecting said plurality of switches to said low voltage AC control unit.

8. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 7 wherein said means for receiving DC input signals comprises a plurality of DC input terminals connected to said plurality of switches via the wires previously connecting said plurality of switches to said low voltage AC control unit.

9. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 3 wherein said means for selectively connecting low voltage AC signals selectively connects low voltage AC signals to said low voltage AC control unit over the wires used to connect said switches to said low voltage AC control unit.

10. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 9 wherein said source of DC voltage comprises means for converting commercial AC voltage into a DC voltage.

11. A range extender module for extending the range capability of a barrier control system comprising a low voltage AC control unit which receives low voltage AC control signals conveyed by wires to input terminals thereof from a plurality of remotely located switches and responds to such AC control signals by controlling the barrier in accordance with claim 3 wherein said means responsive to DC input signals comprises a plurality of DC responsive relays each comprising a normally open contact set and said plurality of relays respond to DC input signals by connecting low voltage AC signals to said low voltage AC control unit by closing and opening their respective contact sets.

* * * * *